United States Patent [19]

Eberhardt

[11] 4,245,952

[45] Jan. 20, 1981

[54] PUMP

[75] Inventor: H. Alfred Eberhardt, Paoli, Pa.

[73] Assignee: Hale Fire Pump Company, Conshohocken, Pa.

[21] Appl. No.: 37,668

[22] Filed: May 10, 1979

[51] Int. Cl.[3] ..... F04B 29/08

[52] U.S. Cl. ..... 415/170 A; 29/156.8 CF; 415/172 R; 415/196; 415/214

[58] Field of Search ..... 415/170 A, 172 R, 214, 415/196, 212 R; 29/156.8 CF

[56] References Cited

U.S. PATENT DOCUMENTS

| | | | |
|---|---|---|---|
| 2,223,653 | 12/1940 | Allen | 415/172 |
| 3,066,612 | 12/1962 | Haentjens | 415/172 X |
| 3,145,912 | 8/1964 | Weis | 415/214 |
| 3,153,382 | 10/1964 | Blarcom, Jr. | 415/170 A |
| 3,220,696 | 11/1965 | Chatfield et al. | 415/170 A |
| 3,677,659 | 7/1972 | Williams | 415/170 A X |
| 3,841,791 | 10/1974 | Doolin | 415/170 A |
| 4,073,596 | 2/1978 | Erickson et al. | 415/175 X |

OTHER PUBLICATIONS

Worthington D-700, Solids Handling and Sewage Pumps, Worthington Standard Pump Division; received in office May 4, 1976.

*Primary Examiner*—Leonard E. Smith
*Attorney, Agent, or Firm*—Frank A. Follmer

[57] ABSTRACT

A centrifugal pump is constructed of a cast iron impeller and corrosion resistant means for providing a minimal clearance space between the impeller and the volute body of the pump in the form of a clearance ring mounted in the volute body to cooperate with a stainless steel tubular insert member cast into the impeller hub. The clearance ring may comprise a bendable ring which may be compressed from its normal condition to fit into a bore in the volute body so as to spring outwardly into its mounted position.

13 Claims, 4 Drawing Figures

PUMP

BACKGROUND AND SUMMARY OF THE INVENTION

In many pump applications, such as in irrigation pumps, there is a trend toward the use of diesel engines to drive the pump shaft. In order to operate efficiently from a fuel conservation standpoint, a diesel engine should operate at a low RPM. This requires that the pump impeller have a large diameter. By way of example, in the case of irrigation pumps of the indicated type, the impeller diameter may be as large as seventeen inches. Heretofore, many irrigation pumps have used bronze impellers in order to prevent corrosion, especially in the close fitting clearance ring area. Fertilizers of various types are often mixed with the liquid being pumped and make the liquid corrosive, even to bronze. Obviously the use of corrosion resistant materials such as bronze or stainless steel would be prohibitive from a cost standpoint, especially when large diameter impellers are used. For economy, for resistance to wear and for withstanding the effects of certain chemicals, it would be desirable to make the impeller out of cast iron. However, the use of a cast iron impeller would not be satisfactory if one used the present-day means for providing a close clearance space between the rotating impeller and the volute body. A cast iron impeller would rust rapidly at this clearance location whereby the impeller would "bind" and the leakage from the discharge side of the impeller to the inlet side would become too great to maintain a satisfactory pump efficiency. A close fit must be maintained at this clearance location in order to maintain the efficiency and to achieve the low fuel consumption desired.

In accordance with the invention, such a clearance space design for a cast iron impeller has been provided. This means includes a corrosion resistant ring mounted in the volute body of the pump and extending around a portion of the impeller hub. A stainless steel tubular insert member is cast into this portion of the impeller hub so as to cooperate with the clearance ring to define the clearance space therebetween. The clearance ring and stainless steel insert member define cooperating surface portions between the rotating impeller and the volute body in the manner to resist corrosion and wear and to maintain a minimum clearance space. The clearance ring may be made in the form of a bendable or flexible ring adapted to be compressed from its normal condition when inserted into its mounted position within a bore in the pump body so as to spring outwardly into its fitted position.

By reason of the novel construction of the invention, the impeller may be made from a relatively inexpensive material such as cast iron. At the same time, the clearance space between the impeller and the volute body is formed by a pair of cooperating members which can withstand wear and are highly corrosion resistant. The use of the bendable corrosion ring provides the advantage that the clearance ring can be replaced easily in the event of wear thereof.

DESCRIPTION OF THE PREFERRED EMBODIMENT

Figure 1:
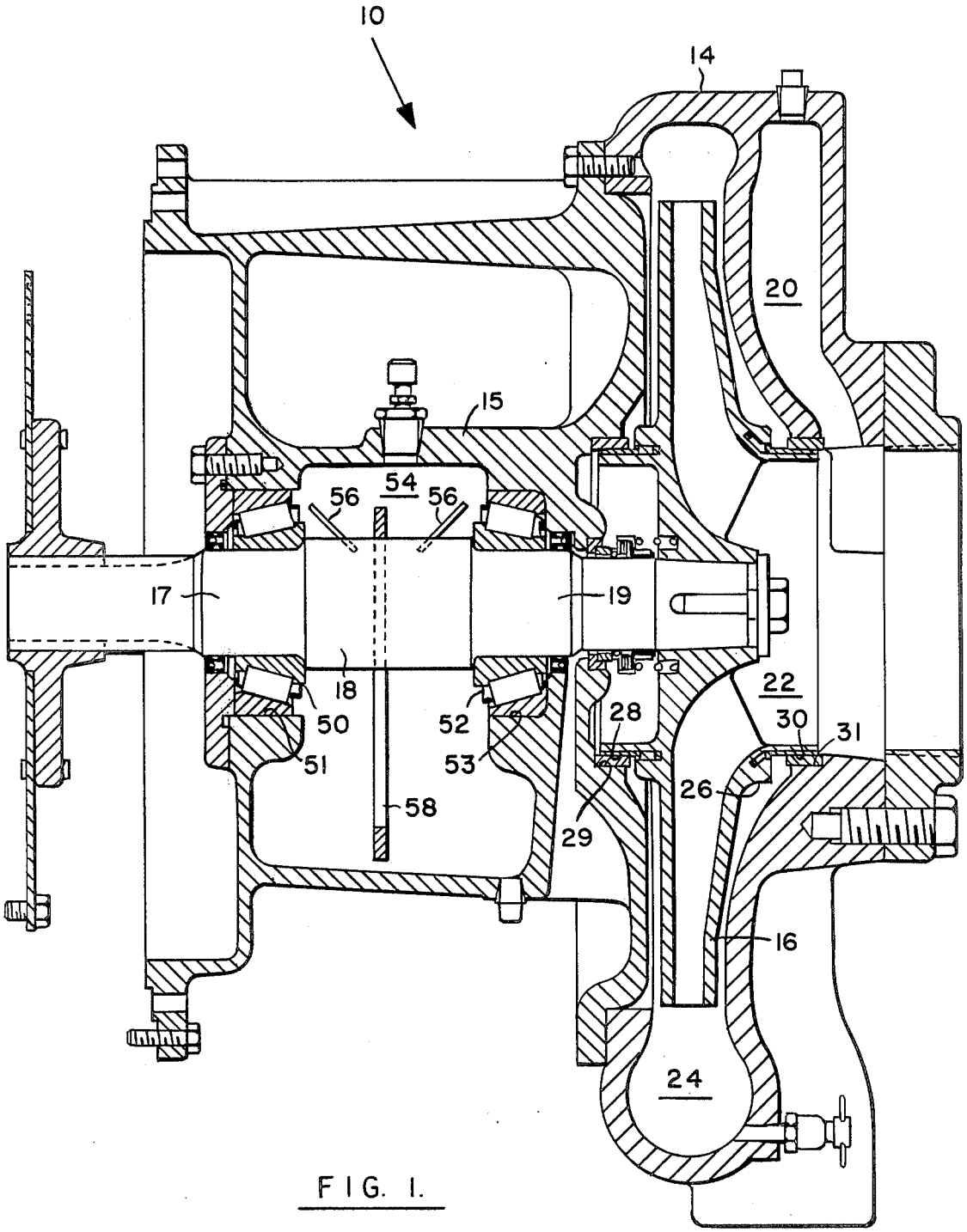
FIG. 1 is a sectional view of a pump in accordance with the invention.
Figure 2:
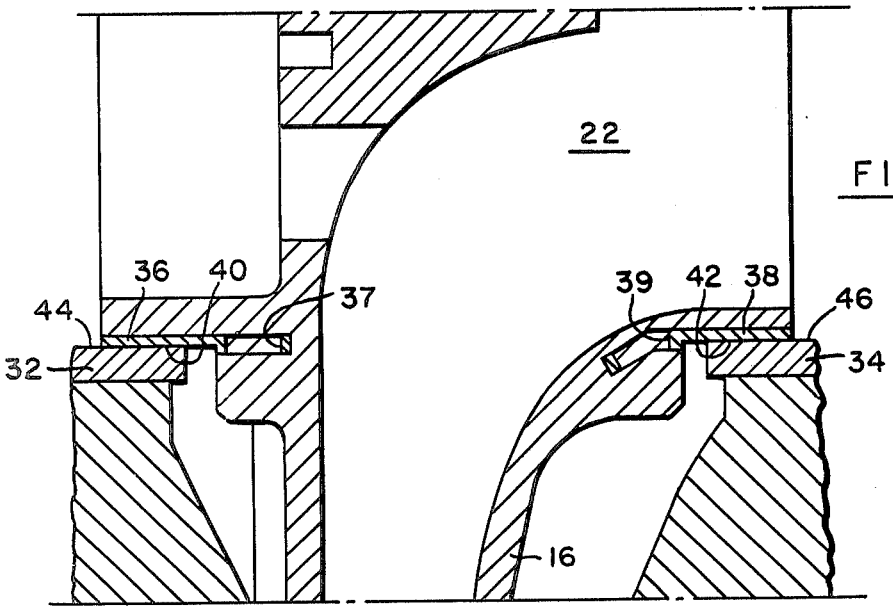
FIG. 2 is an enlarged fragmentary view showing the clearance providing means in accordance with the invention.

In FIG. 1 there is shown a centrifugal pump 10 embodying the clearance space design in accordance with the invention. Pump 10 comprises a pump body 12 having a volute portion 14. An impeller 16 is mounted on one end of an impeller shaft 18, the other end of shaft 18 being connected to a source of power, such as a diesel engine, to drive the same for rotating the impeller 16 to pump liquid at high pressure. Liquid is delivered through an inlet passage 20 to the entrance 22 of impeller 16 at a relatively low inlet pressure. The liquid is discharged from impeller 16 by way of a discharge chamber 24 at a discharge pressure substantially higher than the inlet pressure.

In order to maintain the high efficiency of the pump, it is important that the leakage of the high pressure liquid from discharge chamber 24 back to the relatively low inlet pressure chamber 20 be kept to a minimum. Since the impeller 16 is rotating relative to the pump body, there will, of course, be some clearance space between the impeller 16 and the pump body. It is important that this clearance space be kept to a minimum and be maintained throughout the life of the pump in order to maintain the operating efficiency of the pump.

In the pump 10 of the invention, the impeller 16 is made of cast iron so as to keep the cost thereof relatively low. Since the impeller would typically have a diameter as much as seventeen inches, making the impeller of cast iron has a substantial effect on reducing the cost thereof as compared with other more expensive materials. The hub 26 of impeller 16 is provided with cylindrical hub portions 28 and 30 at the front and back ends of the impeller 16 and located in opposed relation to cylindrical bores 29 and 31 in the pump body.

In accordance with the invention, there is provided novel means for providing a minimum leakage clearance space between the above described opposed body and hub portions, i.e., 28 and 29, and 30 and 31. To this end, cylindrical clearance rings 32 and 34 are mounted in bores 29 and 31, respectively, by means of a force fit to prevent rotation of the clearance rings in their mounted position. Clearance rings 32 and 34 are preferably made of a corrosion resistant material such as bronze or stainless steel depending on the nature of the material being pumped.

A pair of tubular insert members 36 and 38 are integrally cast into the cast iron impeller 16 when it is made to form external cylindrical surfaces 40 and 42. When impeller 16 is mounted in its rotating position, surfaces 40 and 42 are located in opposed relation to internal cylindrical surfaces 44 and 46 of clearance rings 32 and 34, respectively. The parts are constructed and arranged so that there is a minimum of clearance between the opposed surfaces to permit rotation of the impeller 16 within the pump body while, at the same time, keeping the leakage through this clearance space to a minimum.

By being cast into impeller 16, the stainless steel insert members 36 and 38 become imbedded therein to form an integral part thereof. In order to lock insert members 36 and 38 in position, there are provided a plurality of holes 37 and 39, respectively, therein spaced circumferentially thereabout. The molten cast iron will flow into these holes 37 and 38 to fill the same when the impeller 16 is cast.

The means for mounting impeller 16 and shaft 18 for rotation within the pump body comprises a pair of tapered roller bearings 50 and 52. Bearings 50 and 52 are received in bores 51 and 53 in a body portion 15 and support spaced apart reduced diameter portions 17 and 19, respectively, of shaft 18 in order to rotatively support shaft 18 in a horizontally extending position. The portion of shaft 18 between bearings 50 and 52 is contained within a chamber 54 defined by the body portion 15 and the inner portions of bearings 50 and 52. The chamber 54 provides an oil reservoir which is normally filled with oil to a level just below the horizontally extending shaft 18, the oil serving to provide lubrication for the bearings 50 and 52.

A pair of pins 56 are secured on shaft 18 to extend radially outwardly therefrom at an acute angle to the longitudinal axis of shaft 18 as shown in FIG. 1. As shaft 18 rotates, the pins 56 will dip into the oil contained in chamber 54 and will splash the oil throughout the surface walls of the chamber 54. The oil will thus be distributed to the bearings and to the upper wall portion of the chamber formed by the pump body to thereby lubricate the bearings and to provide a cooling effect on the pump body portion 15.

A flat annular ring 58 is loosely supported on shaft 18 between pins 56 to hang downwardly to a location near the bottom of chamber 54 as shown in FIG. 1. The rotation of shaft 18 causes a gradual rotating movement of ring 58 about shaft 18 whereby ring 58 serves to convey oil from the lower portion of chamber 54 onto shaft 18 for distribution to bearings 50 and 52 and to the upper surface walls of chamber 54. The oil delivered to shaft 18 by ring 58 moves axially to bearings 50 and 52 with some of this oil moving radially outwardly along pins 56 to tips thereof whereupon this oil will be splashed onto the upper surface walls of chamber 54. Ring 58 is preferably made of molded rubber or a similar soft material which is inexpensive and will not cause any damage to the bearings if it should break or get out of its place between pins 56.

The inclined arrangement of pins 56 helps to keep ring 58 centered on shaft 18 and to distribute oil throughout chamber 54. It is to be noted that ring 58 will function to convey oil to bearings 50 and 52 even in the event that the oil level in chamber 54 should fall to a low level.

Figure 4:
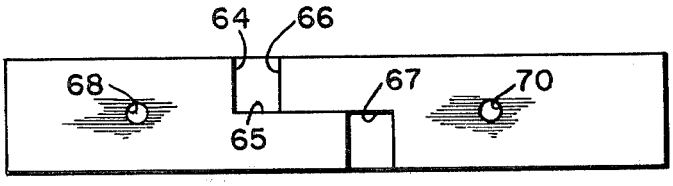
FIG. 4 is a top plan view of the clearance ring shown in FIG. 3.
Figure 3:
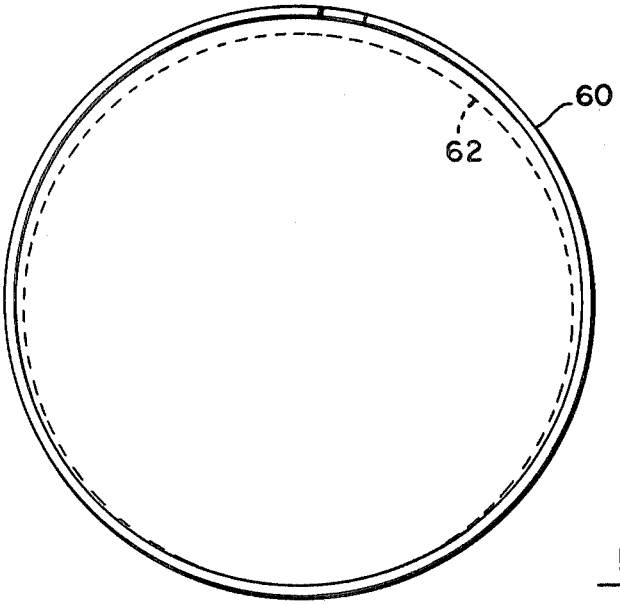
FIG. 3 is an elevational view of a clearance ring in accordance with the invention.

In FIGS. 3 and 4, there is shown a clearance ring 60 constructed so that it can be installed and replaced easily in its mounted position with a pump body bore. To this end, clearance ring 60 is designed to be bendable from its solid line position, which is its normal, unbiased position, to a reduced circumference illustrated by the dash line 62 in FIG. 4. By this construction, the flexible clearance ring 60 can be bent or compressed to a reduced circumference before inserting it into a pump body bore which has a diameter less than the normal diameter of compression ring 60. After the compression ring 60 is inserted into the bore, it is allowed to move toward its normal position whereupon it will spring outwardly into biased contact with the pump body bore and be retained in this position. It will be apparent that the compression ring 60 can be easily removed from this position by reversing the installation procedure.

The design for achieving the above described function involves forming a split ring 60 which has ends 64 and 66 spaced apart in the normal condition of ring 60. Each end 64 and 66 is provided with opposed contacting circumferentially extending portions 65 and 67, respectively, between opposed, spaced-apart transverse portions as is shown in FIG. 4. There is also provided a pair of holes 68 and 70 adjacent ends 64 and 66. The holes 68 and 70 can be engaged by a suitable tool for use in compressing ring 60 from the solid line to the dash line position shown in FIG. 3. In FIG. 3, the dash line position is shown in an exaggerated relationship for purposes of illustration. In actual use, the ring need not be bent to the extent indicated in FIG. 3.

It will be apparent that various changes may be made in the construction and arrangement of parts without departing from the scope of the invention as defined by the claims. Thus, the impeller can be made of a plastic (synthetic resin) such as nylon for some applications.

I claim:

1. A pump comprising:

a pump body, an impeller, means mounting said impeller for rotation within said pump body, said impeller having a hub portion, and means providing a clearance space between said impeller hub portion and a portion of said pump body including a clearance ring mounted within said portion of said pump body and providing an internal cylindrical surface, said hub portion having means providing an external cylindrical surface in opposed relation to said internal cylindrical surface of said clearance ring to cooperate therewith to define a minimal clearance space therebetween as said impeller is rotated within said pump body, said clearance ring being received in a cylindrical bore in said pump body and having end portions spaced apart when said clearance ring is in its normal unbiased condition, said clearance ring being bendable to reduce the circumference thereof with said end portions being moved closed together, said clearance ring being received in said cylindrical bore only when said clearance ring is moved to a reduced circumference condition whereby said clearance ring is biased outwardly against said bore when it is mounted therein.

2. A pump comprising:

a pump body, an impeller made of first material, means mounting said impeller for rotation within said pump body, said impeller having a hub portion, and means providing a clearance space between said impeller hub portion and a portion of said pump body including a clearance ring mounted within said portion of said pump body and providing an internal cylindrical surface, and a tubular insert member integrally cast into said hub portion of said impeller, said tubular insert member providing an external cylindrical surface in opposed relation to said internal cylindrical surface of said clearance ring to cooperate therewith to define a minimal clearance space therebetween as said impeller is rotated within said pump body, said tubular insert member being made of a second material having high corrosion resistance properties substantially greater than said first material.

3. A pump according to claim 2 wherein said clearance ring is made of a material having high corrosion resistance properties.

4. A pump according to claim 2 wherein said clearance ring is received in a cylindrical bore in said pump body and has end portions spaced apart when said clearance ring is in its normal unbiased condition, said clearance ring being bendable to reduce the circumference thereof with said end portions being moved closer together, said clearance ring being received in said cylindrical bore only when said clearance ring is moved to a reduced circumference condition whereby said clearance ring is biased outwardly against said bore when it is mounted therein.

5. A pump according to claim 4 wherein said clearance ring is made of a material having high corrosion resistance properties.

6. A pump according to claim 2 wherein said means for rotatively mounting the impeller comprises a shaft rotatively supported on a pair of bearings spaced apart axially on said shaft to support said shaft to extend along a horizontal axis, said pump body defining an oil reservoir chamber enclosing said pump shaft and located between said spaced apart bearings, said shaft having pin means extending radially therefrom whereby, as the shaft is rotated, said pin means will splash oil contained within said chamber throughout the walls of said chamber to distribute oil to said bearings for lubrication thereof and to the walls of the pump body for cooling the same.

7. A pump according to claim 6 including a ring member loosely supported on said shaft to hang downwardly to a location near the bottom of said oil reservoir chamber.

8. A pump according to claim 7 wherein said pin means includes a pair of pins spaced apart axially on said shaft, said ring member being supported on said shaft between said pins.

9. A pump according to claim 8 wherein said pins extend at an acute angle to the longitudinal axis of said shaft.

10. A pump according to claim 2 including means providing a clearance space between said impeller hub portion and a portion of said pump body at a location spaced from the first-mentioned clearance providing means, said last-mentioned clearance providing means including a cylindrical clearance ring mounted on said pump body and providing an internal cylindrical surface and a tubular insert member secured to said hub portion of said impeller, said tubular insert member providing an external cylindrical surface in opposed relation with said internal cylindrical surface of said clearance ring to cooperate therewith to define a small clearance space therebetween as said impeller is rotated within said pump body, said last-mentioned tubular insert member being made of said second material.

11. A pump according to claim 10 wherein said impeller is made of cast iron and said insert members are made of stainless steel.

12. A pump according to claim 10 wherein said tubular insert members have a plurality of openings therein filled with said first material.

13. A pump according to claim 10 wherein said impeller is made of a plastic (synthetic resin).

* * * * *